United States Patent [19]

Poeppel et al.

[11] Patent Number: 4,705,563

[45] Date of Patent: Nov. 10, 1987

[54] METHODS AND APPARATUS FOR REDUCING CORROSION IN REFRACTORY LININGS

[75] Inventors: Roger B. Poeppel, Glen Ellyn; Sherman Greenberg, Oak Lawn; Dwight R. Diercks, Plainfield, all of Ill.

[73] Assignee: The United States of America as represented by the United States Department of Energy, Washington, D.C.

[21] Appl. No.: 922,363

[22] Filed: Oct. 23, 1986

[51] Int. Cl.[4] ..... C22B 9/00

[52] U.S. Cl. ..... 75/95; 75/10.14; 75/96; 266/220; 266/270

[58] Field of Search ..... 75/10.14, 95, 96; 266/220, 270

[56] References Cited

U.S. PATENT DOCUMENTS

| | | | |
|---|---|---|---|
| 2,446,637 | 8/1948 | Crampton | 75/10.14 |
| 2,715,062 | 8/1955 | Osborn | 75/10.14 |
| 3,154,404 | 10/1964 | Lorenz | 75/10.14 |
| 3,233,017 | 2/1966 | Weaver et al. | 264/63 |
| 3,330,645 | 7/1967 | Moustier et al. | 75/60 |
| 4,340,208 | 7/1982 | Vayssiere et al. | 266/220 |
| 4,438,907 | 3/1984 | Kimura et al. | 266/217 |
| 4,560,149 | 12/1985 | Hoffgen | 266/220 |

*Primary Examiner*—Peter D. Rosenberg

*Attorney, Agent, or Firm*—Hugh W. Glenn; Robert J. Fisher; Judson R. Hightower

[57] ABSTRACT

Methods and apparatus are provided for reducing corrosion in a refractory lining of a liquid-containing vessel used in direct steelmaking processes. The vessel operates at between about 1600° C. and about 1800° C. and an oxygen partial pressure of about $10^{-12}$ atmospheres, creating slag which is rich in FeO. The refractory lining includes a significant level of chromium oxide ($Cr_2O_3$), and has small interconnected pores which may be filled with a gas mixture having a higher total pressure and oxygen partial pressure than the total pressure and oxygen partial pressure associted with the liquid against the lining of the vessel.

The gas mixture is forced through the pores of the lining so that the pores are continuously filled with the mixture. In this manner, the gas mixture creates a blanket which increases the oxygen partial pressure at the lining enough to maintain the chromium in the lining in a selected valence state in which the chromium has decreased solubility in the FeO slag, thereby reducing corrosion by the FeO and increasing the useful life of the refractory lining.

7 Claims, 2 Drawing Figures

METHODS AND APPARATUS FOR REDUCING CORROSION IN REFRACTORY LININGS

The United States has rights in this invention pursuant to Contract No. DE-AC02-84GC20057 between the U.S. Department of Energy and Argonne National Laboratory.

BACKGROUND OF THE INVENTION

This invention relates to methods and apparatus for reducing corrosion in porous refractory linings, and more particularly to methods and apparatus for reducing corrosion in refractory linings which contain chromia.

Iron alloys, including steel, can be produced by a number of different processes, including direct steelmaking. In the direct steelmaking process, concentated ore is placed in a furnace which operates at temperatures on the order of between about 1600° C. and about 1800° C., considerably above the melting point of the ore. The molten metal is contained in a vessel which includes a refractory lining on the inside of the vessel walls. As the molten metal is processed, undesired matter rises to the top of the molten metal and forms slag. The slag also includes matter added intentionally to remove impurities from the ore. The slag prevents the usable product beneath the slag from oxidizing, but the slag itself is an undesirable byproduct of the process and is eventually removed and discarded.

In direct steelmaking processes, concentrated iron ore in the form of hematite ($Fe_2O_3$), magnetite ($Fe_3O_4$) or the like is transformed through chemical reactions into wustite (FeO). The FeO becomes substantially pure iron (Fe) through further processing. Direct steelmaking processes have advantages over some other steelmaking processes because the capital costs of production are relatively low. However, the FeO is highly corrosive and dissolves most of the materials which are commonly used in refractory linings.

In direct steelmaking processes, some of the FeO does not undergo further reactions, but rises to the top of the molten metal and resides in the slag. In general, in direct steelmaking processes, the slag contains about 25 to 35 percent FeO. Temperatures of between about 1600° C. and about 1800° C., and such high iron oxide levels, create severe conditions which are very corrosive and destroy refractory lining materials. Thus, there is a need for refractory linings for vessels used in direct steelmaking processes which are resistant to corrosion when in contact with FeO at high temperatures, or processes which protect refractory linings under such conditions.

Some coal gasifiers operate at lower temperatures and lower FeO concentrations than the direct steelmaking processes just discussed. To resist chromiamagnesia corrosion, spinels containing about 80 percent chromium oxide ($Cr_2O_3$) have been used in the refractory lining materials of the coal gasifiers.

Chromium is a multivalent metal. Chromium in the +3 valence state ($Cr^{+3}$) is only slightly soluble by corrosive materials such as FeO, while chromium in the +2 valence state ($Cr^{+2}$) is much more soluble and therefore vulnerable to corrosive chemicals. The valence state of chromium in refractory linings is determined by the temperature and the oxygen partial pressure at the lining.

Oxygen partial pressure is related to both the total gas pressure on a surface, and the concentration of oxygen at the surface. In the atmosphere, for example, air is about 80 percent nitrogen and about 19 percent oxygen, with traces of other elements, of course. The total pressure of the air is 1 atmosphere, and the ambient oxygen partial pressure is approximately 0.2 atmospheres.

The oxygen partial pressure in coal gasifiers is between about $10^{-10}$ and $10^{-8}$ atmospheres. At those pressures, the chromium in the refractory lining is maintained in the +3 valence state, which is only slightly soluble and is quite resistant to corrosion by FeO.

The refractory lining materials used in the coal gasifiers could be used in the direct steelmaking processes just discussed, but the oxygen partial pressure is several orders of magnitude lower in the direct steelmaking processes than it is in the coal gasifiers, and the chromium in the spinels will change to a +2 valence state. Such a change in valence state is undesirable because it results in a higher corrosion rate of the lining. Thus, there is a need for methods and apparatus for maintaining multivalent metal cations used in refractory linings in the most chemically resistant valence state. There is also a need for methods and apparatus for maintaining chromium used in refractory linings for metal producing processes having iron oxide as a byproduct in the +3 valence state.

Accordingly, one object of this invention is to provide new and improved methods and apparatus for resisting corrosion in refractory linings used in metal making processes.

Another object is to provide new and improved methods and apparatus for maintaining multivalent metal cations used in refractory linings in the most chemically resistant valence state.

Still another object is to provide new and improved methods and apparatus for maintaining chromium in the +3 valence state when used in refractory linings in direct steelmaking processes which operate between about 1600° C. and about 1800° C., and have FeO as a byproduct.

SUMMARY OF THE INVENTION

In keeping with one aspect of this invention, methods and apparatus are provided for reducing corrosion in a refractory lining in a molten metal containing vessel which operates at between about 1600° C. and about 1800° C. The refractory lining includes a significant level of chromium oxide ($Cr_2O_3$), and contains small interconnected pores which may be filled with a slightly oxidizing gas mixture having a higher total pressure and oxygen partial pressure than the total pressure and oxygen partial pressure associated with the molten metal present at the lining of the vessel. The gas mixture could include any of a variety of combinations of gases, such as carbon monoxide (CO) and carbon dioxide ($CO_2$), hydrogen ($H_2$) or water vapor ($H_2O$). Such mixtures may include, without limitation, the following combinations: $CO/CO_2$; $H_2/H_2O$; $H_2/CO_2$. In general, a reducing agent in combination with an oxygen source is used so that an equilibrium is established between the two gases in situ, and the desired oxygen partial pressure is generated.

The gas mixture is forced through the pores of the lining so that the pores are continuously purged or filled with gas, and a partial oxygen pressure of about $10^{-10}$ atmospheres is created at the interface of the refractory lining and the slag. In this manner, the gas, at equilibrium, creates a blanket which increases the oxygen partial pressure at the lining enough to prevent the chromium in the lining from entering the +2 valence state. In addition, the gas blanket may at least partially physically isolate the lining from the slag.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings in which.

DETAILED DESCRIPTION

Figure 1:
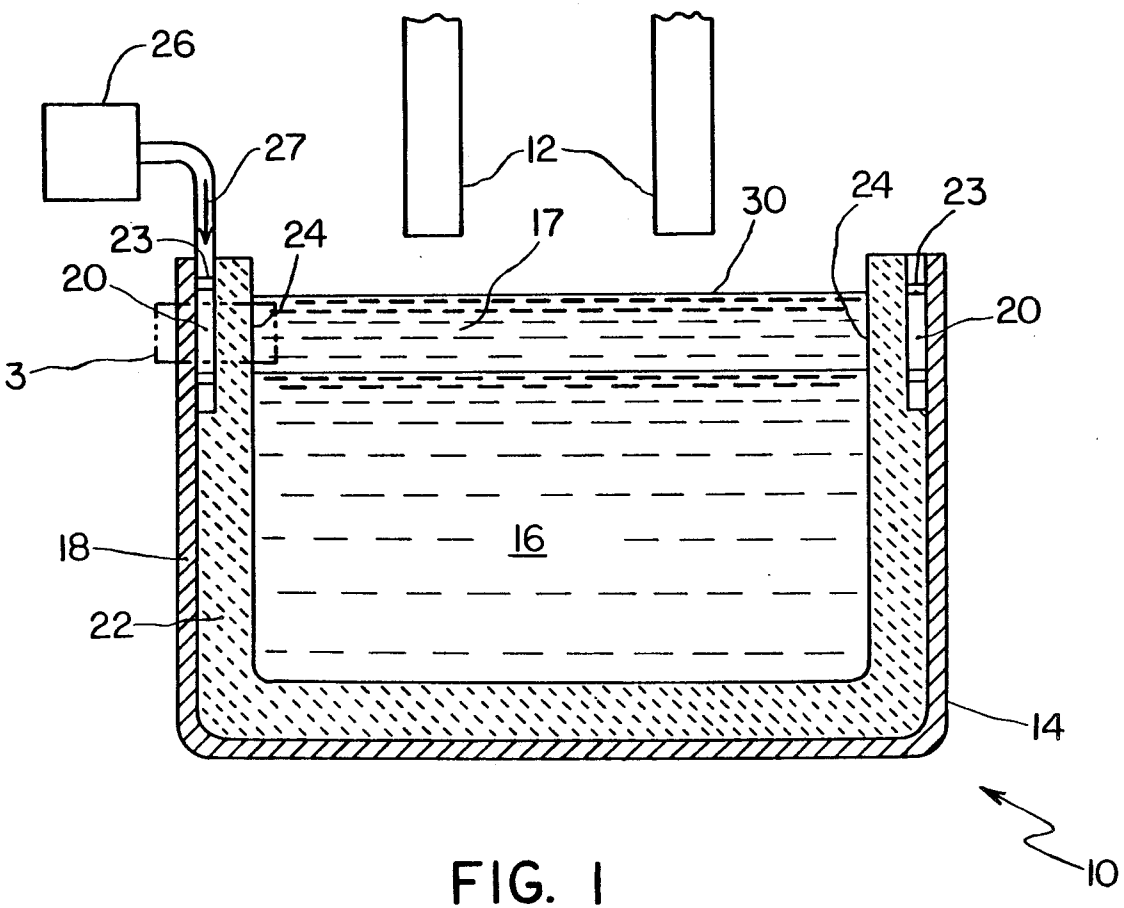
FIG. 1 is a cut-away elevation view of a furnace made in accordance with this invention.

As seen in FIG. 1, a furnace 10 includes a heat source 12 (e.g., electric-arc heating) and a vessel 14 which holds molten metal, such as iron ore or steel materials. The desired end product, which is processed molten iron or steel 16, is at the lower portion of the vessel 14. A layer of undesired by-products 17, commonly known as slag, forms on the top surface of the metal 16. In contemplated applications, the processed molten metal 16 is iron, steel or the like, and the slag 17 includes a substantial percentage of iron oxide in the form of FeO. The temperature inside the furnace 10 is between about 1600° C. and about 1800° C., and the FeO content of the slag 17 may be on the order of about 25 to 35 percent, which makes the slag 17 very corrosive. The oxygen partial pressure in the slag 17 is about $10^{-12}$ atmospheres.

The vessel 14 includes an outer shell 18, a gas inlet passage 20, and a refractory lining 22 on the inside surface of the shell 18. The inlet passage 20 is between the shell 18 and the lining 22. The refractory lining 22 is porous at least over the portion which is in contact with the slag, and the pores are formed so that gas can flow through the refractory lining 22.

The inlet passage 20 extends any suitable distance along the refractory lining 22, but at least below the interface of the metal 16 and the slag 17. The passage 20 is maintained by a plurality of spacers 23 or any other suitable structure.

The refractory lining 22 contains a significant level of chromium oxide ($Cr_2O_3$). Pure chromium oxide may be used, or any chromium oxide magnesia (MgO), or chromium oxide-alumina ($Al_2O_3$) refractory material containing at least about 60 percent chromium oxide. Chromium oxide magnesia spinels which contain about 80 percent $Cr_2O_3$ are preferred.

The refractory lining 22 may be fabricated by any of a number of known ways. One known practice is to incorporate a controlled amount and size distribution of pore formers (discrete particles of polymers or other organic materials) into the green refractory before firing. During firing of the green refractory, the particles burn off or volatilize, leaving behind a porous microstructure in the refractory. The porous microstructure permits gas to flow through the refractory lining 22 from the gas inlet passage 20 to an interface 24 of the refractory 22 and the slag 17.

Figure 2:
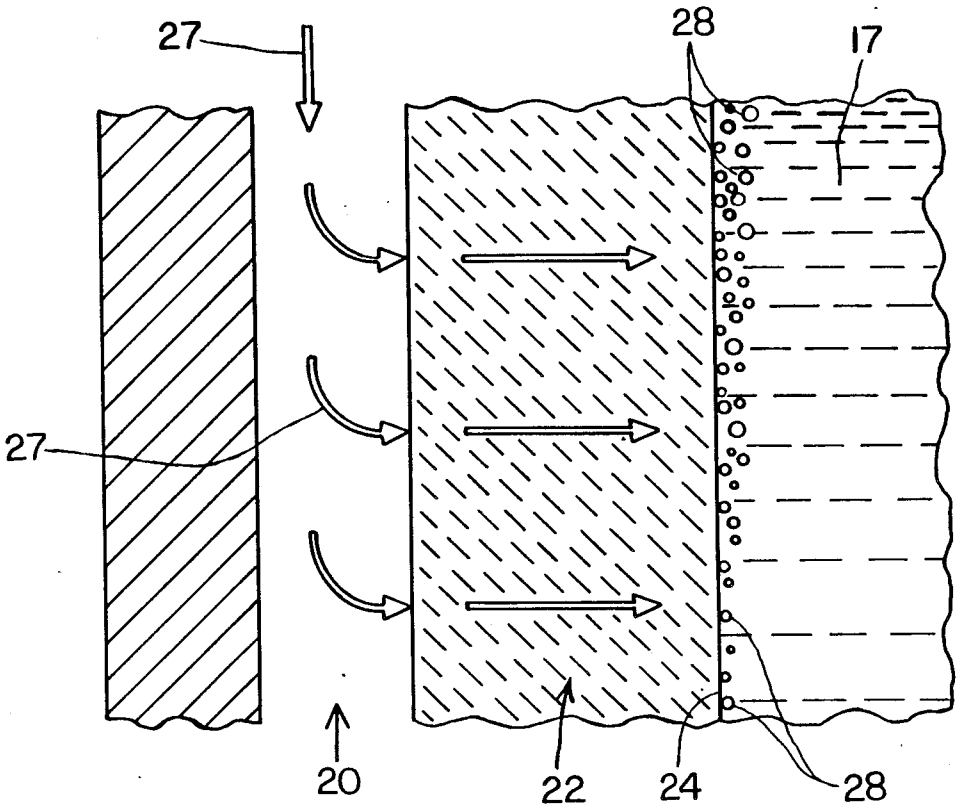
FIG. 2 is a detailed view showing an enlarged portion of the furnace of FIG. 1 identified by numeral 3.

A gas source 26 is provided for introducing a desired gas mixture into the gas inlet passage 20 in the direction of arrows 27 in FIGS. 1 and 2. The gas mixture is under sufficient total pressure so that it is forced through the porous refractory 22 to the interface 24 with the metal 16 and the slag 17, forming gas bubbles 28 at the interface 24. The gases are released at the surface 30 of the slag 17.

The protective gas mixture supplied by the gas sources 26 create an equilibrium reaction mixture which liberates oxygen in desired amounts to create an oxygen partial pressure of between about $10^{-8}$ to $10^{-10}$ atmospheres at the interface 24. The relative amounts of the gas mixture constituents may be adjusted to provide the desired level of oxygen partial pressure. A variety of gas mixtures could be used, in relative amounts which produce a mixture having slightly oxidizing properties, creating the oxygen partial pressures discussed above, including carbon monoxide (CO), carbon dioxide ($CO_2$), hydrogen ($H_2$) or water ($H_2O$). At temperatures of between about 1600° C. and about 1800° C., the oxygen partial pressure requirements may be met by using either a $CO_2/CO$ gas mixture containing from about 0.5 to about 17 percent $CO_2$, a $H_2O/H_2$ gas mixture containing from about 2 to about 50 percent $H_2O$, or a $CO_2/H_2$ gas mixture containing from about 3 to about 36 percent $CO_2$. The use of other gas mixtures is contemplated, as well.

The solubility of chromium in slag which contains FeO is strongly dependent on the valence state of the chromium. $Cr^{+3}$ is only slightly soluble in such slag, while $Cr^{+2}$ is very soluble. At temperatures of between about 1600° C. and about 1800° C., chromium is generally in the +2 valence state at an oxygen partial pressure of about $10^{-12}$ atmospheres, and it is in the +3 valence state at those temperatures and partial oxygen pressures of about $10^{-10}$ to $10^{-8}$ atmospheres. Since the direct steelmaking proceses just discussed are expected to produce oxygen partial pressures on the order of $10^{-12}$ atmospheres, the chromium enters the +2 valence state during processing of the iron ore and is eaten away in the corrosive FeO slag. By establishing an oxygen partial pressure of about $10^{-10}$ to $10^{-8}$ atmospheres at the interface 24, the chromium may be maintained in the +3 valence state. This is achieved by supplying a selected gas mixture, as previously discussed, at a suitable pressure through the refractory lining 22. The gas mixture has a total pressure which is sufficient to overcome the ferrostatic pressure of the slag 17 against the lining 22, and creates an oxygen partial pressure of about $10^{-10}$ to $10^{-8}$ atmospheres at the interface 24. The gas mixture provides a higher oxygen partial pressure at the lining 22 which chemically maintains the chromium in the desired +3 valence state. To some extent, the gas may also physically isolate the refractory lining 22 from the slag 17. In addition, the gas flow has a small cooling effect, which further reduces the corrosion rate. However, the mass flow rate of the gas should not be so high that the rate of iron or steel production is significantly reduced.

This invention may be used for many applications, although the preferred applications involve steel production, and more particularly, steel made by direct steelmaking processes which create slag having a relatively high percentage of FeO. Such slag creates very severe conditions which can destroy the refractory lining 22 of the vessel 14 at an accelerated rate with the chromium in the +2 valence state.

EXAMPLE

A refractory lined furnace has a 60 percent chromium oxide refractory lining. The refractory lining is porous and allows the passage of gases from the inlet passage to the refractory/slag interface. The furnace is filled with iron ore materials and heated to a temperature of between about 1600° C. and about 1800° C. The ore materials melt and separate into an upper slag portion containing FeO and a lower processed iron portion. The oxygen partial pressure at the upper surface of the slag is approximately $10^{-12}$ atmospheres.

A source of pressurized gas is connected to the refractory lining to permit the controlled passage of gases uniformly to the interface of the slag and the lining. The gas source forces a gas mixture through the pores of the lining to the interface of the lining with the slag. A series of gas mixtures is used in the evaluation of the subject invention. They are as follows:

(1) $CO_2/CO$ mixture with approximately 3 percent $CO_2$.

(2) $H_2O/H_2$ mixture with approximately 11 percent $H_2O$.

(3) $CO_2/H_2$ mixture with approximately 12 percent $CO_2$.

A partial pressure of oxygen of approximately $10^{-9}$ atmospheres is observed at 1700° C. at the interface of the lining with the slag for each of the above mixtures. Refractory lifetimes in excess of 100 heats are anticipated utilizing any of the above three gas mixtures, provided that the partial pressure of oxygen is maintained as set forth. Minimal erosion of liner material is observed when such oxygen partial pressures are maintained, the thickness of the liner material undergoing minimal changes.

The advantages of this invention are now apparent. Corrosion of the refractory lining is significantly reduced because the oxygen partial pressure is increased by the gas mixture at the lining slag interface and the chromium is maintained in the +3 valence state. Corrosion may be further reduced by the cooling effect of the gas at the surface. These advantages are realized without significantly reducing the rate of iron or steel production.

While the present invention is susceptible of embodiment in many different forms, there is shown in the drawings and described in the detailed description several specific embodiments, with the understanding that the invention is not limited thereto except insofar as those who have the disclosure before them are able to make modifications and variations therein without departing from the scope of the invention.

The embodiments of this invention in which an exclusive property or privilege is claimed are defined as follows:

1. A process for maintaining chromium ions in a +3 valence state, the valence of the chromium ions being determined by the temperature and the oxygen partial pressure at the chromium ions, the process comprising the steps of:

maintaining the chromium ions at a temperature between about 1600° C. and 1800° C.; and introducing a gas mixture through a porous refractory wall of a vessel in which the porous refractory wall includes the chromium ions, the gas mixture maintaining an oxygen partial pressure between about $10^{-10}$ and $10^{-8}$ atmospheres at the chromium ions, the gas chemically protecting the chromium ions to control the valence state of the chromium ions.

2. A process for producing steel by a direct steel-making process in a vessel having a porous refractory lining, the lining having chromium for the purpose of resisting corrosion, comprising the steps of:

placing iron ore materials in the vessel, said ore materials contacting the lining;

heating said materials and the lining to a temperature of between about 1600° C. and about 1800° C., said temperature causing said ore materials to melt and react to form steel and a layer of undesired end products over said steel and adjacent said lining, said undesired end products including FeO; and introducing a gas mixture through the pores of the lining, the gas mixture creating an oxygen partial pressure of between about $10^{-10}$ and $10^{-8}$ atmospheres where said ore contacts the lining.

3. The process of claim 1 wherein said gas is a mixture of gases selected from the group consisting of carbon monoxide, carbon dioxide, and hydrogen.

4. The process of claim 1 wherein said gas mixture includes water vapor.

5. The process of claim 1 wherein said chromium is in a plurality of spinels containing chromium oxide, said spinels being in a porous refractory lining in a vessel, said vessel containing molten metal, and said molten metal including FeO.

6. The process of claim 2 wherein said gas mixture has gases selected from the group consisting of carbon monoxide, carbon dioxide, hydrogen and water vapor.

7. The process of claim 2 wherein said FeO is typically between about 25 to 35 percent of said undesired end products.

* * * * *